United States Patent [19]

Birch et al.

[11] Patent Number: 4,564,955

[45] Date of Patent: Jan. 14, 1986

[54] COUPLING FOR USE IN THE SECURING OF A HOOK-SHAPED SOUND PART ON A BEHIND-THE-EAR HEARING AID

[75] Inventors: Leon Birch, Stenløse; Jørgen Hartmann, Glostrup, both of Denmark

[73] Assignee: Danavox A/S, Copenhagen, Denmark

[21] Appl. No.: 543,291

[22] Filed: Oct. 19, 1983

[30] Foreign Application Priority Data

Nov. 5, 1982 [DK] Denmark ..... 4920/82

[51] Int. Cl.[4] ..... H04R 25/00

[52] U.S. Cl. ..... 381/69; 179/107 H

[58] Field of Search ..... 381/69; 179/107 H, 107 R, 179/107 E, 182 R

[56] References Cited

U.S. PATENT DOCUMENTS

| | | | |
|---|---|---|---|
| 3,491,214 | 1/1970 | Rosemond et al. | 179/107 H |
| 3,813,499 | 5/1974 | Viginini | 179/107 H |
| 4,296,829 | 10/1981 | Pedersen | 179/107 H |

*Primary Examiner*—Thomas W. Brown
*Assistant Examiner*—Danita R. Byrd
*Attorney, Agent, or Firm*—Darby & Darby

[57] ABSTRACT

A coupling for use in securing a hook-shaped sound part on a behind-the-ear hearing aid consists of a two part connector with a free position in which the parts can be assembled and separated, and a coupled position in which the hook-shaped part can be turned in relation to the hearing aid. A coupling link with a plug-shaped part is inserted in the hearing aid so that the plug-shaped part extends outside the aid and can engage with a coupling hole formed in the hook-shaped part. On the plug-shaped part of the coupling link there is a partly circular groove which can engage with a projecting wall part in the form of a dowel inserted in a hole at right angles to the coupling hole. An O-ring is disposed between the two parts and around the plug-shaped part of the coupling link. When the plug-shaped part of the coupling link engages with the projecting wall of the hook-shaped part, the coupling is in its free position. When the hook-shaped part is turned away from this position, the two parts are locked together. One thus achieves a coupling without a thread and which is easy to operate when the hook-shaped part is to be removed for replacement or cleaning.

6 Claims, 5 Drawing Figures

Figure 1:
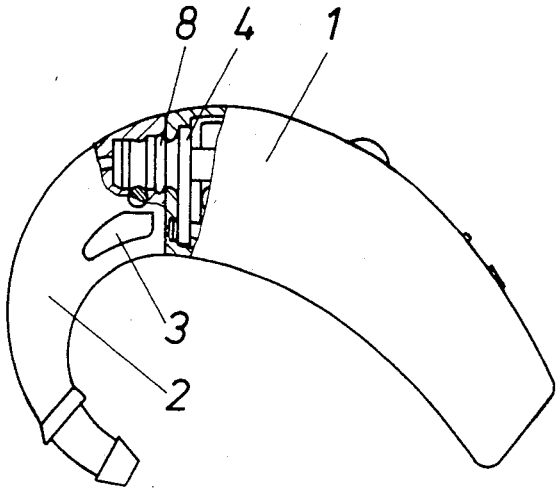

COUPLING FOR USE IN THE SECURING OF A HOOK-SHAPED SOUND PART ON A BEHIND-THE-EAR HEARING AID

The invention relates to a coupling for use in the securing of a hook-shaped sound part on a behind-the-ear hearing aid.

Hearing aids for placing behind the ear often consist of a hearing aid housing containing a microphone, amplifier with regulation elements, battery and sound producer, and a hook-shaped part which is hollow and has one end arranged to be connected with the sound output of the housing and which serves, by means of a through-going channel, to transfer the sound from the sound producer to the ear, preferably through a tube which is mounted on the hook-shaped part and which conducts the audio signal to an earplug mounted on the tube. By virtue of its form, the hook-shaped part also contributes towards bearing the hearing aid directly on the outer ear.

With the known hearing aids, the hook-shaped part is normally formed from a semi-stiff plastic material, for example polyethylene, which is easy to mould to a suitable shape. The hook-shaped part is secured to the hearing aid housing by means of a plug of hard plastic material or metal extending from the housing, said plug being provided with an external thread with evenly rounded thread tops. Without the hole in the hook-shaped part being provided with an internal thread, said hook-shaped part can be screwed on to the threaded plug because it is made of semi-stiff material, which by elastic deformation forms a thread corresponding to the threaded plug. For the coupling together to be sufficiently solid, one must, however, surround that end of the hook-shaped part which is led in over the plug with a metal stiffening ring. The reason why one is unable to use a normal threaded assembly is that the hook-shaped part must be capable of being turned and adjusted individually by the user, so that it suits the user's ear, but without it thus coming to sit too loosely on the aid or without the thread being ruined. The hook-shaped part must also be capable of being removed by the user when it needs to be cleaned or exchanged.

There is also a need for the hook-shaped sound part to be exchangeable when the acoustic characteristics of the aid need to be changed. For this purpose there are produced hook-shaped parts with different acoustic qualities, namely with different sound channels or with built-in acoustic filters or other acoustic adjustment devices.

The choice of materials enabling the hook-shaped part to be formed as explained above is limited, and one therefore often uses polyethylene, which is semi-stiff. Moreover, this material makes it necessary to use a metal ring as reinforcement, and both the whitish plastic and the shiny metal ring give the hearing aid an appearance which is unattractive.

The object of the present invention is to provide a coupling for use in the securing of a hook-shaped sound part on a behind-the-ear hearing aid which enables said hook-shaped part to be removed and mounted in a simple manner. Particularly because many hearing impaired are also elderly people, the coupling must be formed in such a way that the elderly themselves can easily separate and mount the hook-shaped part, also even if their hands shake a great deal or when they happen to have poor eyesight. Here it is especially necessary that no threaded assembly be used, the reason being that the parts not only need to be brought precisely together, but also turned in a certain direction towards each other.

This object is achieved by forming the coupling so that the coupling has two positions; one position in which it is possible to assemble and separate the two parts, and a position which is the normal position in use where one can still turn the hook-shaped part so that it fits precisely to the ear, but without any risk of loosening the assembly. The possibility is thus provided of choosing between many different materials for the manufacture of the coupling parts, in that one is not dependent on being able to provide threads herein. Moreover, where the appearance of the hearing aid is concerned, it is also important that one is able to avoid the metal ring which must otherwise be used for reinforcement. Any user is able to remove and mount the hook-shaped sound part on his or her hearing aid in an easy manner, in that the assembly is now so simple that it is not even necessary to look at the aid while removing or mounting the hook-shaped part.

In one embodiment the plug part sits on the housing of the hearing aid itself, and the coupling hole in the hook-shaped part.

This is expedient for several reasons. Partly because it is the hook-shaped part which needs to be able to be removed for cleaning or replacement, whereby one avoids having to exchange more than necessary, and partly because it is easier to produce hook-shaped parts with different acoustic characteristics when the hook-shaped part starts with a coupling hole rather than a coupling plug.

In a further embodiment, one provides a lock which functions in the same way regardless of the direction in which the hook-shaped part is turned after the parts have been assembled. By varying how great a part of the plug-shaped part's circumference the peripheral groove shall extend, one is able to change the relationship between the extent of the free position and the coupled together position. It has been found to be practical for the free position that is the position in which the hook-shaped part is detachable to extend over approx. 10° to 30°, and for the coupled together position to extend over approx. 330° to 350°, but this can be changed all depending on use and requirements.

From the point of view of production technique, a particularly simple but very advantageous way of forming the outwardly-projecting wall part in the coupling hole is also described. Moreover, this results in a very reliable coupling which, with a suitable choice of materials, is also secured against damage, in that one can actually remove the hook-shaped part without destroying the coupling, even though it is mounted in the coupled together position.

The coupling is preferably provided with a gasket. By arranging a circular gasket, a so-called O-ring, one achieves an essentially airtight assembly in a simple manner. This is of significance for the acoustic adaptation between the sound outlet and the sound channel in the hook-shaped part. Moreover, by using a flexible gasket one achieves a certain elasticity and a certain friction between the hook-shaped part and the housing of the hearing aid.

By forming the coupling as described in the attached specification, a very well-defined free position is obtained, thus making it simple to assemble and separate the parts, even for those whose hands shake a great deal or who have poor eyesight, the reason being that it is a quite simple matter to find the free position without looking at the aid.

Figure 2:
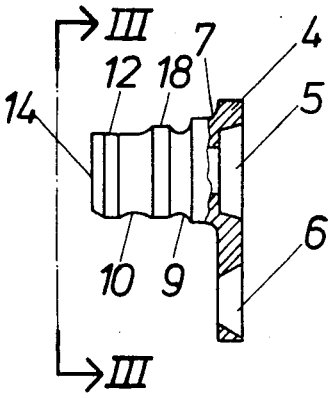
Figure 3:
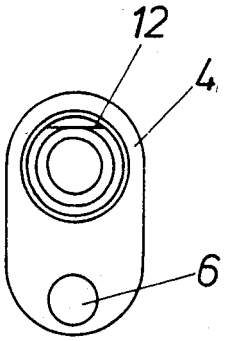
Figure 4:
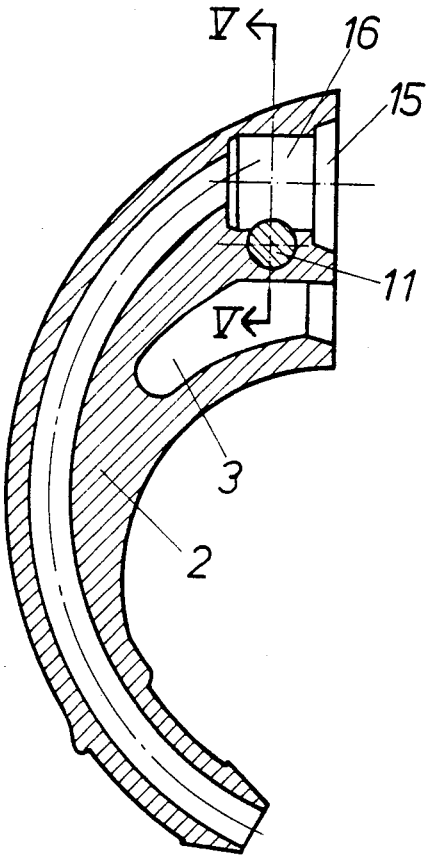
Figure 5:
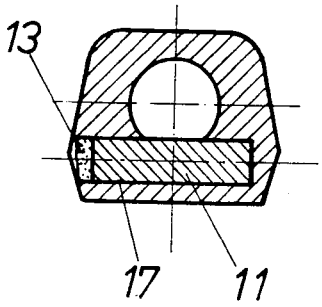

The invention will now be described in more detail with reference to the drawing, which shows an example of a preferred embodiment, and where FIG. 1 shows, partly in section, a hearing aid with a coupling according to the invention, FIG. 2 shows a plane section in a coupling link for use in the coupling according to the invention, FIG. 3 shows the coupling link in FIG. 2, but seen in the direction III—III, FIG. 4 shows a plane section in a hook-shaped part on a larger scale, showing the construction of the coupling hole, and FIG. 5 shows a plane section in the hook-shaped part in FIG. 4, seen in the direction V—V.

In the drawing, the hearing aid itself or the housing of the hearing aid is indicated by the reference numeral 1, while 2 indicates the hook-shaped part, also called a hook. In FIG. 1 the two parts are seen in the coupled together condition, in that coupling link 4, which is seen more clearly in FIGS. 2 and 3, with an O-ring 8 is inserted and secured in a coupling hole in the hook-shaped sound part 2. The rest of the actual hearing aid 1, i.e. its electrical and acoustic arrangements, are not shown or discussed, since these do not form a part of the present invention which relates only to the coupling between the housing 1 and the hook-shaped sound part 2. The opening 3 in the hook-shaped part serves to ensure the passage of sound into the microphone opening in the hearing aid.

In a preferred embodiment, the coupling consists of a coupling link 4, which is shown in FIGS. 2 and 3, and a coupling hole 16 in the hook-shaped part 2, which is shown in FIGS. 4 and 5.

The coupling link 4 comprises a plug-shaped part 14 with a through-going hole which has an enlarged part 5, so that acoustically it suits the aid's sound producer. Under the through-going hole there can be disposed a flange with a sound hole 6 which acoustically suits the aid's microphone. In the plug-shaped part 14 there is formed a partly peripheral groove 10 having an arcuate profile, in that a part of the one side of the groove 12 is removed, for example by making it flat, see particularly FIG. 3. Between the other side 18 of the groove and the coupling link 4, a peripheral groove 9 is provided in which an O-ring 8 can be placed. Moreover, the transition 7 between the plug-shaped part 14 and the actual coupling link 4 is rounded or formed so that it fits in a correspondingly shaped hole in the hearing aid 1, see particularly FIG. 1, where the positioning of the O-ring 8 is also shown.

In the hook-shaped part 2, see FIGS. 4 and 5, there is a coupling hole 16 with a circular bevel 15 suitable for the O-ring. Provided at right angles to the hole 16 is a further hole 17 which partially intersects hole 16, see FIG. 5, so that a dowel 11 which is inserted in and fills out the hole 17 forms a projecting wall part which can engage with the groove 10 when the coupling is assembled. The dowel 11 is inserted in the hole 17 by press-fitting, where it is also secured by a blob of glue 13.

When a hook-shaped part 2 is required to be mounted on a hearing aid 1, this is carried out by turning the hook-shaped part 180° in relation to the position in which it is shown in FIG. 1. Using light pressure, the hook-shaped part 2 is introduced over the plug-shaped part 14 on the coupling link 4 which fits into the coupling hole 16. The hook-shaped part 2 is then turned around the axis of the plug 14 to that position shown in FIG. 1. As soon as the hook-shaped part 2 has been turned so much that the dowel 11 engages in the groove 10, the parts can no longer be separated without deforming them under elastic strain. The hook-shaped part 2 can be turned in relation to the hearing aid without the parts being loosened, in that the O-ring 8 provides a suitable friction. Regardless of the position of the hook-shaped part 2 in relation to the housing 1, there is a constant and unchanged acoustic connection from the sound producer through the hole in the coupling link 4 to the channel in the hook-shaped part 2.

Since the coupling together is based on a two part coupling which can be turned in either direction and all the way around, one is completely free with regard to the choice of materials for the hearing aid housing 1 and the hook-shaped part 2. Therefore, for example, it is possible to make the hook-shaped sound part of knock-proof acryl, which can be coloured or tinted as desired. Furthermore, and of special importance, one can avoid the use of any form of unsightly metal reinforcement. The coupling link 4 is made as a form moulded unit, preferably of a hard plastic material.

In the drawing is shown an example of one embodiment of the invention, where the microphone inlet is shown below the sound outlet, but this is only an example of the application of the invention. It will be obvious to those familiar with the technique that the disposition and dimensioning of a coupling according to the invention can be effected in many different ways without deviating from the scope of the invention.

What is claimed is:

1. A two part coupling for use in a behind-the-ear hearing aid, said hearing aid having a hook-shaped part for conducting sound and a hearing aid body, said coupling comprising:

a coupling aperture disposed in said hookshaped part with a projecting wall partially extending into said coupling aperture;

a coupling link having a substantially cylindrical plug-shaped part and having a longitudinal axis, said coupling link being mounted on said hearing aid body for conducting sound therefrom, a section of said plug-shaped part having a portion with an arcuate cross-section transverse to said longitudinal axis, said portion including a partly annular groove therein parallel to said cross-section and further including a flat portion having a substantially flat surface transverse to said longitudinal axis, said plug-shaped part engaging with said coupling aperture, wherein said two part coupling includes a free position in which said hook-shaped portion and said hearing aid body can be separated and assembled, and a coupling position in which said hook-shaped portion is coupled to said hearing aid body and to which said hook-shaped portion can be turned in relation to said hearing aid body.

2. The coupling according to claim 1, wherein the projecting wall part is formed by a substantially cylindrical dowel (11) which is inserted in a hole (17) at right angles to the coupling hole (16) in the hook-shaped part (2), so that a part of the cylindrical surface of the dowel (11) extends into the coupling hole.

3. The coupling according to claims 1 or 2, wherein a flexible gasket (8) is disposed between the hook-shaped part (2) and the hearing aid (1), said gasket being placed in and encircling a second groove (9) in the plug-shaped part (14) of the coupling link (4), wherein said coupling aperture is provided with an open end having a bevelled periphery.

4. The coupling according to claim 1, wherein said two part coupling is separated and assembled when said projecting wall is aligned with said flat portion.

5. The coupling according to claim 2 wherein said two part coupling is separated and assembled when said projecting wall is aligned with said flat portion.

6. The coupling according to claim 3 wherein said two part coupling is separated and assembled when said projecting wall is aligned with said flat portion.

* * * * *